United States Patent [19]

Warlick

[11] Patent Number: 4,468,151

[45] Date of Patent: Aug. 28, 1984

[54] ASSEMBLY FOR DAMPING SEA WAVES

[76] Inventor: R. Patterson Warlick, Old Chester Rd. (P.O. Box 1180), Rte. 2, Chester, N.J. 07930

[21] Appl. No.: 368,426

[22] Filed: Apr. 14, 1982

[51] Int. Cl.[3] ..... E02B 3/06

[52] U.S. Cl. ..... 405/27; 405/31

[58] Field of Search ..... 405/21, 25, 26, 27, 405/28, 30, 31, 34, 35

[56] References Cited

U.S. PATENT DOCUMENTS

| | | | |
|---|---|---|---|
| 2,857,872 | 10/1958 | Usab . | |
| 2,984,076 | 5/1961 | Bradley . | |
| 3,276,210 | 10/1966 | Stitt . | |
| 3,353,361 | 11/1967 | Lloyd | 405/28 |
| 3,357,192 | 12/1967 | Hibarger . | |
| 3,534,558 | 10/1970 | Bouteiller | 405/26 |
| 3,777,689 | 12/1973 | Olsen et al. . | |
| 3,884,042 | 5/1975 | Anderson et al. | 405/27 |
| 3,953,977 | 5/1976 | Kikui et al. . | |
| 4,028,899 | 6/1977 | Carmichael . | |

*Primary Examiner*—David H. Corbin
*Attorney, Agent, or Firm*—Robert Scobey

[57] ABSTRACT

An assembly for damping sea waves that constitutes a floating breakwater for protecting a sea wall. A plurality of vertical pilings extend into the sea bed and are spaced apart from each other and extend parallel to the sea wall. Automobile tires are positioned about the pilings and are supported by a platform made of struts on opposite sides of the pilings that extend parallel to the sea wall, with transverse stringers maintaining the struts in parallel and spaced relationship and also free to move vertically with respect to the pilings. The combined buoyancy of the tires and platform is such that the top surfaces of the tires are positioned substantially at the surface of the sea. A support beam structure is attached to the pilings generally along the tops thereof and interconnects the pilings, together with rigid tie-back members that connect the pilings to the sea wall, all to aid in maintaining the pilings in vertical and spaced-apart relationship.

3 Claims, 1 Drawing Figure

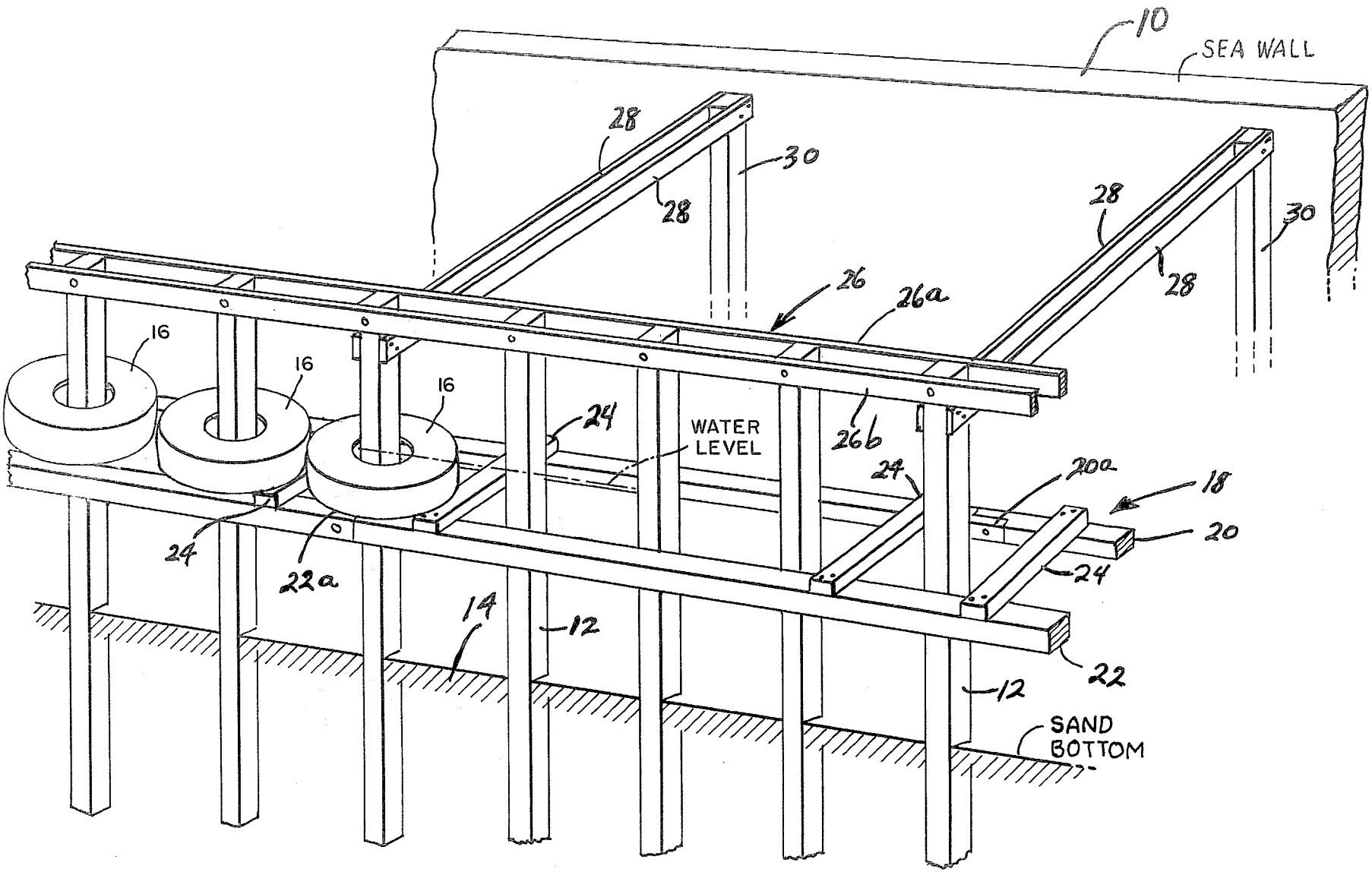
SEA WALL
10
30
28
28
18
20
20a
24
22
SAND BOTTOM
12
26a
26b
24
26
30
WATER LEVEL
28
28
24
12
14
16
16
16
22a
24

ASSEMBLY FOR DAMPING SEA WAVES

BACKGROUND AND BRIEF DESCRIPTION OF THE INVENTION

This invention relates to assemblies for damping sea waves, and more particularly to a floating breakwater structure to protect a sea wall.

Floating breakwater structures are known. Most are anchored to the sea bed, and suffer from the problem of rusting of anchor chains. The present invention is directed to a floating breakwater that does not utilize anchor chains, and which provides a structure, the integrity of which will be maintained in heavy seas, and which is highly effective in damping sea waves.

Briefly, the invention involves use of vertical pilings which extend into the sea bed and are spaced from and parallel to a sea wall to be protected. Doughnut-shaped energy absorbing members, preferably automobile tires, are positioned about the vertical pilings and are free to move vertically with respect to the pilings. A buoyant platform supports the energy absorbing members, and is made of struts positioned on opposite sides of the pilings and extending parallel to the sea wall. Transverse stringers maintain the struts in parallel and spaced relationship to each other and free to move vertically with respect to the pilings. The combined buoyancy of the energy absorbing members and the platform is such that the top surfaces of the energy absorbing members are positioned substantially at the surface of the sea, thereby providing a structure which extends into the sea toward the sea bed to provide effective sea wave damping. A support beam structure is attached to the pilings generally along the tops thereof, interconnecting the pilings to aid in maintaining the pilings in vertical and spaced-apart relationship. Additionally, rigid tie-back members interconnect the pilings and the sea wall to aid in maintaining the pilings in vertical and spaced-apart relationship.

Thus, an assembly is provided which is highly effective in damping sea waves, and which is mechanically sound and strong so that it resists damage in heavy seas.

The invention will be more completely understood by reference to the following detailed description, to be read in conjunction with the attached drawing.

BRIEF DESCRIPTION OF THE DRAWING

The single FIGURE of the drawing illustrates an assembly for protecting a sea wall that constitutes a presently preferred embodiment of the invention.

DETAILED DESCRIPTION

Referring to the FIGURE, a sea wall 10 is to be protected. Vertical pilings 12 extend into sea bed 14, which is illustrated as being a typical sand bottom. The vertical pilings 12 are spaced from and parallel to the sea wall 10, extending in a line parallel to that wall. Doughnut-shaped energy absorbing members 16, which preferably are automobile tires, are positioned each about an individual one of the vertical pilings 12. The energy absorbing members are free to move vertically with respect to the pilings. A buoyant platform 18 is included for supporting the energy absorbing members 16. The platform is made of struts 20 and 22 positioned on opposite sides of the vertical pilings 12 and extending parallel to the sea wall 10. Transverse stringers 24 are included which maintain the struts 22 in parallel and spaced relationship with respect to each other and free to move vertically with respect to the pilings. The struts 20 and 22 are each joined, as at **20*a* and 22*a***. Preferably, the joints are staggered with respect to each other.

The combined buoyancy of the energy absorbing members 16 and the supporting platform 18 is such that the top surfaces of the energy absorbing members 16 are positioned substantially at the surface of the sea, which is indicated by the dashed line in the FIGURE designated "water level". In this fashion, virtually the entire floating platform 18 and energy absorbing members 16 are positioned at and below the surface of the sea, to provide for the most effective damping of sea waves by this floating structure.

A support beam structure 26 is included, consisting of beams **26*a* and 26*b* attached to the vertical pilings 12 along the tops thereof and interconnecting the pilings. The support beam structure aids in maintaining the pilings in vertical and spaced-apart relationship and also provides a limit on the upward movement of the energy absorbing members and the platform. Rigid tie-back members 28 are also included, connected to the pilings 12 and to vertical pilings 30 that may form a part of the sea wall 10. These tie-back members serve to enhance the structural support of the system and to maintain the pilings 12** in vertical and spaced-apart relationship.

The assembly just described may be provided for any length of sea wall. The struts 20 and 22 are jointed, as necessary, with the joints preferably being staggered as noted. The same may be true with respect to the support members **26*a* and 26*b* at the top of the pilings 12**.

In a sea wall that has been actually constructed, treated pilings 12 generally 6 inches by 6 inches by 14 feet were employed, spaced 2 feet apart from each other. These pilings were driven into the sea bed for a distance of approximately 7 feet, leaving approximately 7 feet above the sea bed. The support members **26*a* and 26*b* generally were constituted by 2 inch by 8 inch wood members bolted to the vertical pilings, as shown in the figures. The tie-backs 28 were constituted by 2 inch by 6 inch by 12 feet wood members, connected to posts 30 along the sea wall. The floating platform was constituted by lumber pieces 3 inches by 6 inches, as were the stringers 24. Staggered joints 20*a* and 22*a*** were spaced-apart from each other generally by 8 feet. The automobile tires employed were positioned horizontally on the support platform, as shown in the FIGURE, with the tread surfaces thereof tangentially positioned with respect to each other.

Thus, a highly effective and structurally secure assembly for protecting a sea wall has been provided. It is obvious that modifications of the presently preferred embodiment may be made. Accordingly, the invention should be taken to be defined by the following claims.

I claim:

1. A floating breakwater for protecting a sea wall comprising a plurality of vertical pilings extending into the sea bed and spaced from and parallel to said sea wall and about which are positioned doughnut-shaped energy absorbing members free to move vertically with respect to said pilings, a buoyant platform supporting said energy absorbing members, said platform comprising struts on opposite sides of said pilings and extending parallel to said sea wall and including transverse stringers maintaining said struts in parallel and spaced relationship to each other and free to move vertically with respect to said pilings, the combined buoyancy of said energy absorbing members and said platform being such that the top surfaces of said energy absorbing members are positioned substantially at the surface of the sea, a support beam structure attached to said pilings generally along the tops thereof and interconnecting said pilings to aid in maintaining said pilings in vertical and spaced-apart relationship and providing a limit on upward movement of said energy absorbing members and said platform, and rigid tie-back members connected to said pilings and said sea wall to aid in maintaining said pilings in vertical and spaced-apart relationship.

2. A floating breakwater according to claim 1, in which said struts are each jointed, and the joints of said struts are staggered with respect to each other.

3. A floating breakwater according to claim 1 or claim 2, in which said energy absorbing members are automobile tires.

* * * * *